US007500860B2

(12) United States Patent
Tajiri et al.

(10) Patent No.: US 7,500,860 B2
(45) Date of Patent: Mar. 10, 2009

(54) LEVER TYPE CONNECTOR INCLUDING ROTATION RESTRICTING PORTION

(75) Inventors: Yoji Tajiri, Inukami-gun (JP); Toshihiro Yoshida, Inukami-gun (JP); Yasuharu Suruga, Inukami-gun (JP); Katsunori Takeda, Inukami-gun (JP); Takeshi Watanabe, Inukami-gun (JP); Hiroshi Kobayashi, Okazaki (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/874,567

(22) Filed: Oct. 18, 2007

(65) Prior Publication Data

US 2008/0096408 A1 Apr. 24, 2008

(30) Foreign Application Priority Data

Oct. 19, 2006 (JP) ..... 2006-285457

(51) Int. Cl.
*H01R 13/62* (2006.01)

(52) U.S. Cl. ..... 439/160

(58) Field of Classification Search ..... 439/160, 439/159, 157, 153, 352, 372
See application file for complete search history.

(56) References Cited

U.S. PATENT DOCUMENTS 6,183,277 B1 2/2001 Okabe et al.
6,213,794 B1 4/2001 Okabe et al.
6,413,105 B2 * 7/2002 Noro et al. ..... 439/157
6,755,674 B2 * 6/2004 Fujii et al. ..... 439/157
6,942,504 B2 * 9/2005 Shinozaki et al. ..... 439/157
7,004,769 B1 * 2/2006 Putnam et al. ..... 439/157
7,189,086 B2 * 3/2007 Fukatsu et al. ..... 439/157
7,234,952 B2 * 6/2007 Sasaki et al. ..... 439/157
7,255,581 B2 * 8/2007 Yamaoka ..... 439/157
7,300,294 B2 * 11/2007 Fukatsu et al. ..... 439/157
7,311,535 B2 * 12/2007 Taguchi et al. ..... 439/157

(Continued)

FOREIGN PATENT DOCUMENTS

JP 2000-58191 2/2000

(Continued)

OTHER PUBLICATIONS

U.S. Appl. No. 11/874,567, filed Oct. 18, 2007, Tajiri, et al.

(Continued)

*Primary Examiner*—Chandrika Prasad
(74) *Attorney, Agent, or Firm*—Oblon, Spivak, McClelland, Maier & Neustadt, P.C.

(57) ABSTRACT

A lever type connector in which a connector holder is reliably fit into a receptacle holder to prevent a half-fitting is provided. In the lever type connector, a restricting recess is provided on the front side of an arm plate of a lever, and below a multiple force recess. When a connector holder is inserted into the receptacle, a rear surface of the restricting recess abuts to a rear surface of a receiving portion to restrict rotation of the lever. Then, when the connector holder is pushed down to the standby position where the receiving portion is inserted into the multiple force recess, the restricting recess is away from the rear surface of the receiving portion, so that restriction of rotation of the lever is cancelled.

15 Claims, 3 Drawing Sheets

U.S. PATENT DOCUMENTS

| | | | | |
|---|---|---|---|---|
| 7,351,094 | B2 * | 4/2008 | Miyamoto | 439/447 |
| 2002/0137377 | A1 | 9/2002 | Okabe et al. | |
| 2007/0026709 | A1 * | 2/2007 | Fukatsu | 439/157 |
| 2008/0096397 | A1 * | 4/2008 | Tajiri et al. | 439/34 |
| 2008/0102668 | A1 * | 5/2008 | Ikeya et al. | 439/157 |

FOREIGN PATENT DOCUMENTS

| | | |
|---|---|---|
| JP | 2000-91026 | 3/2000 |
| JP | 2002-298978 | 10/2002 |
| JP | 2005-293996 | 10/2005 |
| JP | 2007-66816 | 3/2007 |

OTHER PUBLICATIONS

U.S. Appl. No. 11/874,503, filed Oct. 18, 2007, Tajiri, et al.

* cited by examiner

LEVER TYPE CONNECTOR INCLUDING ROTATION RESTRICTING PORTION

This application claims the benefit of Japanese Patent Application Number 2006-285457 filed on Oct. 19, 2006, the entirety of which is incorporated by reference.

BACKGROUND OF THE INVENTION

1. Field of the Invention

The present invention relates to a lever type connector which is used for a branching connection of a wire harness disposed in an automobile, for example.

2. Description of the Related Art

A conventional lever type connector includes a connector holder capable of holding a plurality of terminals, and a receptacle connector capable of holding a terminal corresponding to a terminal of the connector holder, and when the connector holder is fit at a predetermined fitting position, the terminals are connected to each other. The connector holder has a lever which is rotatable in the upper and lower directions.

In this lever type connector, when the lever is rotated after the connector holder is set to a standby position with respect to the receptacle connector, a fulcrum retaining portion provided with the lever is held by a retained portion provided with the receptacle connector. Consequently, the connector holder is pushed down to the side of the receptacle connector by the principle of leverage, so that the connector holder and the receptacle connector are coupled to each other with low fitting power (for example, please refer to Japanese publication of unexamined patent application No. 2002-298978).

During assembling of this kind of lever type connector, there is a case that the lever is rotated in a state that the connector holder is not completely fit to a standby position with respect to the receptacle connector. In this case, when the lever is forcibly rotated, a fulcrum retaining portion of the lever or a retained portion of the receptacle connector may be deformed or damaged. Moreover, the connector and the receptacle connector may be half-fitted, whereby conduction between the terminals may be insufficient.

In view of the above, an object of the present invention is to provide a lever type connector where the connector holder and the receptacle connector are reliably coupled, and half-fitting is prevented.

SUMMARY OF THE INVENTION

In order to achieve the above object, the invention according to a first aspect is characterized in that a lever and a receptacle connector respectively include restricting portions which interfere with each other until a connector holder reaches a standby position so as to restrict rotation of the lever.

The invention according to a second aspect is characterized in that, in addition to the object of the first aspect, the restriction portion on the side of the lever is juncturally provided with the fulcrum retaining portion, in order to obtain the restricting portion with a rational structure. The restrict portion of the lever abuts to the retained portion of the receptacle connector until the connector holder reaches the standby position, so that rotation of the lever is restricted.

According to the first aspect, the lever is prevented from rotating until the connector holder reaches the standby position with a simple structure where the restricting portion is provided. Therefore, there is no need to concern about damage of the lever and the like, and the connector holder and the receptacle holder are firmly coupled, whereby half-fitting is prevented.

According to the second aspect, in addition to the effect of the first aspect, a rational structure is achieved where the retained portion, which is a multiple force is applied to, serves as a restricting portion as well. Further, a metal mold is easily prepared since there is no need to have a complex and special structure in order to obtain the effect of the first aspect, so that cost will not be increased. Moreover, because the mechanical structure is simplified, there is an advantage that secured mechanical strength of the lever type connector is obtained.

DESCRIPTION OF THE PREFERRED EMBODIMENT

Hereinafter, an embodiment of the present invention will be explained with reference to the drawings.

Figure 1:
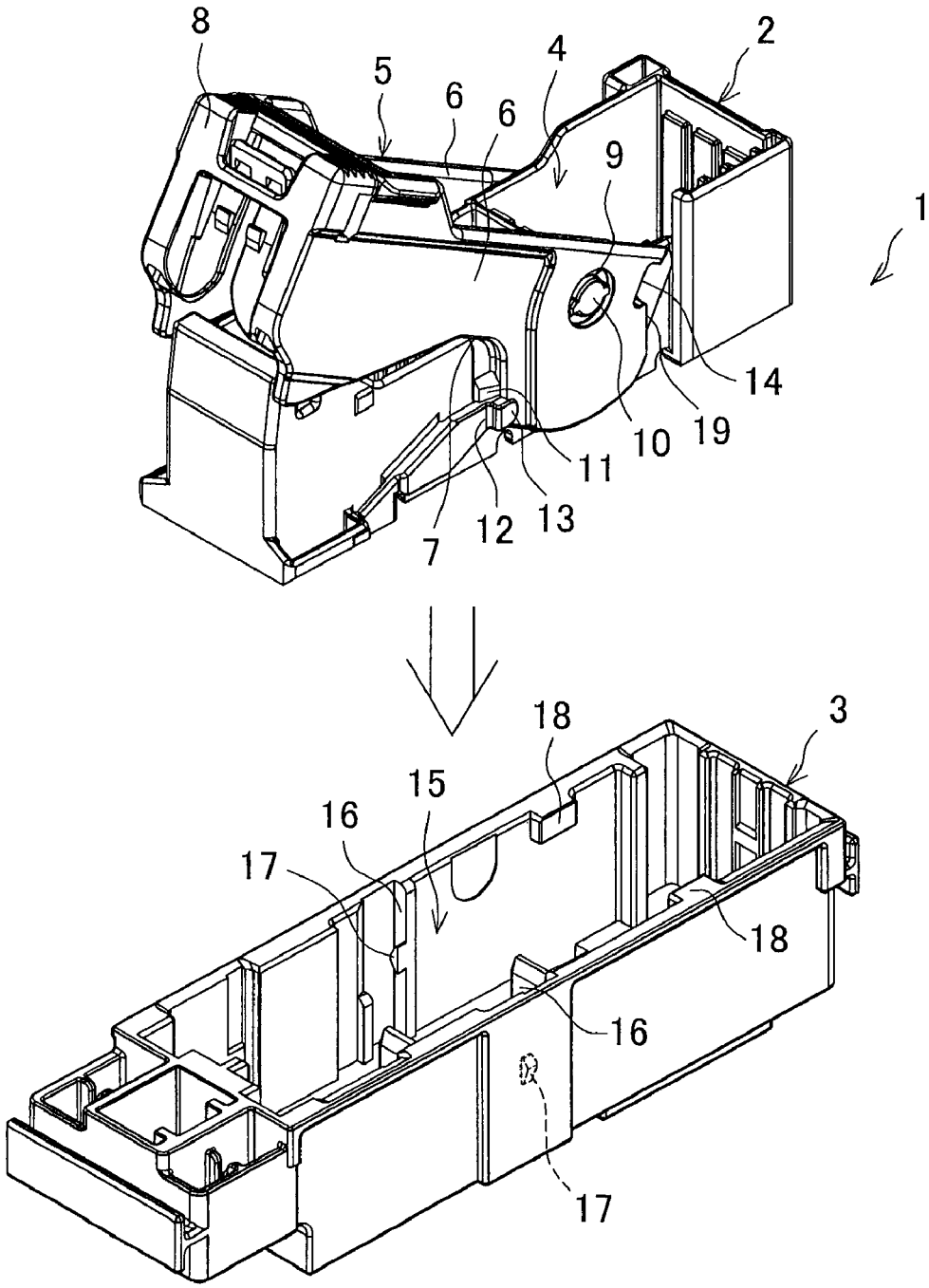
FIG. 1 is a perspective view of a lever type connector.

FIG. 1 is a perspective view of an example of a lever type connector. The lever type connector 1 includes a connector holder 2 and a receptacle connector 3 into which the connector holder 2 is inserted to be fit.

The connector holder 2 is of an elongate box shape and made of synthetic resin. A receiving portion 4 is defined within the connector holder 2, and in the receiving portion 4 a not shown female connector where a plurality of terminal insertion portions can be incorporated is provided. The reference number 5 denotes a lever which is U-shaped viewed from the above, including a pair of right and left arm plates 6, 6 having a recessed portion 7 at the bottom center thereof, and an operating portion 8 connecting the rear ends of the arm plates 6, 6 (here, the upper right is the front in this figure). A circular projection 10 is provided on a lateral outer surface of the connector holder 2, and a hole 9 is defined near the front edge of each arm plate 6. By fitting the circular projection 10 into the hole 9, the lever 5 is connected to the connector holder 2 around a circular projection 10 rotatably in the upper and lower directions.

On the edge of the recessed portion 7 of each arm plate 6, a projection 11 is projecting toward an outer side. On the other hand, on a lateral outer surface of the connector holder 2, a retaining claw 12 having an elasticity to be deformed in the widthwise direction of the connector 2 is provided. The retaining claw 12 is held by the projection 11 at an inclined position of the lever 5 as shown in FIG. 1 in a normal state, and restricting rotation of the lever 5 in the lower direction. The retaining claw 12 has a cancellation portion 13 projecting forward from a portion outer than a retaining portion with respect to the projection 11.

Moreover, on an outer surface of the front edge of each arm plate 6, which is ahead of the circular projection 10, a multiple force recess 14 which is U-shaped viewed from the side serving as a fulcrum retaining portion in fitting into the receptacle connector 3 is defined.

On the other hand, the receptacle connector 3 is of an elongate box shape and made of synthetic resin, and has a housing portion 15 for the connector holder 2. On the bottom portion of the receptacle connector, a terminal insertion hole is defined to house a not shown terminal corresponding to each terminal of the female connector held by the connector holder 2.

Moreover, ribs 16, 16 are provided in the vertical direction on an inner side of the housing portion 15 in the lengthwise direction. The ribs 16, 16 are positioned slightly ahead of the retaining claw 12 when the connector holder 2 is housed. On the rear side of each rib 16, a cancellation projection 17 which is held by the cancellation portion 13 of the retaining claw 12 of the connector holder 2 at a standby position where the connector holder 2 is not completely fit into the receptacle holder 3. At this position, the cancellation portion 13 is deformed to the outer side, so that the retaining claw 12 is away from the projection 11. This cancellation projection 17 is mountain-like shaped where the center in the vertical direction is a top portion recessed to the inner side of the receptacle connector 3.

Moreover, on the front side of an inner surface of the housing portion 15, rectangular receiving portions 18, 18 are provided so as to be opposed. Left and right multiple force recess 14, 14 of the lever 5 engage with the receiving portions 18, 18 when the connector holder 2 is at the standby position to be fit into the housing portion 15. In other words, when an operating portion 18 of the lever 5 is pushed down at the standby position where a part of the receiving portion 18 is inserted into the multiple force recess 14, the bottom of the multiple force recess 14 abuts to the lower surface of the receiving portion 18, so that the lever 5 rotates around an abutting portion as a fulcrum.

Figure 2A:
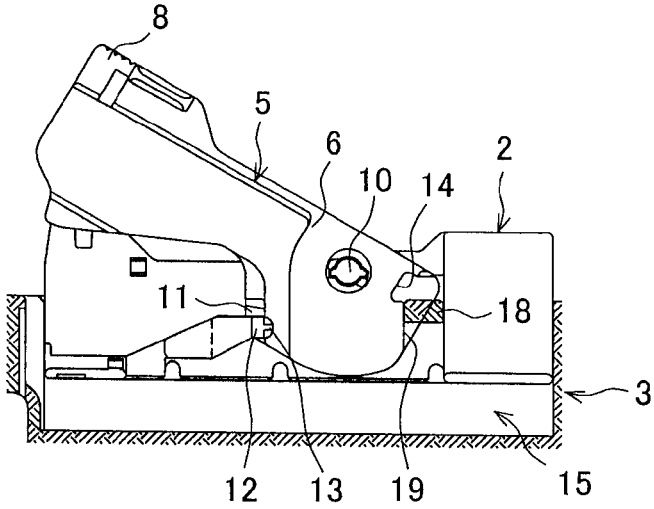
FIGS. 2A-2D are explanation views showing a fitting operation of a connector holder sequentially.

On the front side of the arm plate 6 of the lever 5, a restricting recess 19 as a restricting portion is continuously provided below the multiple force recess 14. When the lever 5 is at a position shown in FIG. 1, a rear surface of the restricting recess 19 extends in the vertical direction to be parallel with a rear surface of the receiving portion 18. When the connector holder 2 is inserted into the receptacle 3 in this state, as shown in FIG. 2A, a rear surface of the restricting recess 19 abuts to a rear surface of the receiving portion 18 to restrict rotation of the lever 5. Here, the receiving portion 18 also serves as a restricting portion on the side of the receptacle connector 3.

Figure 2B:
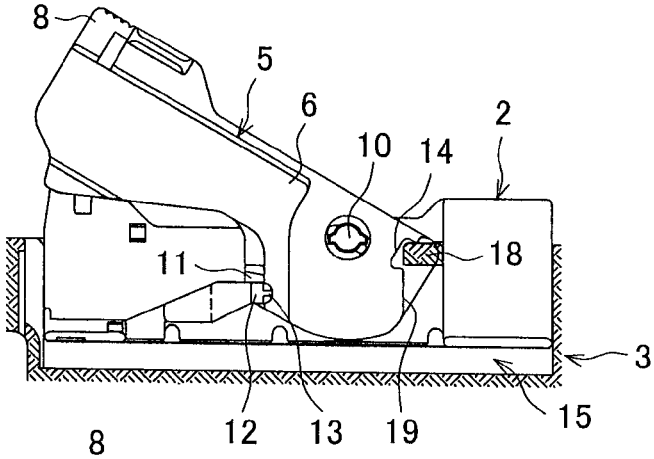
Figure 2C:
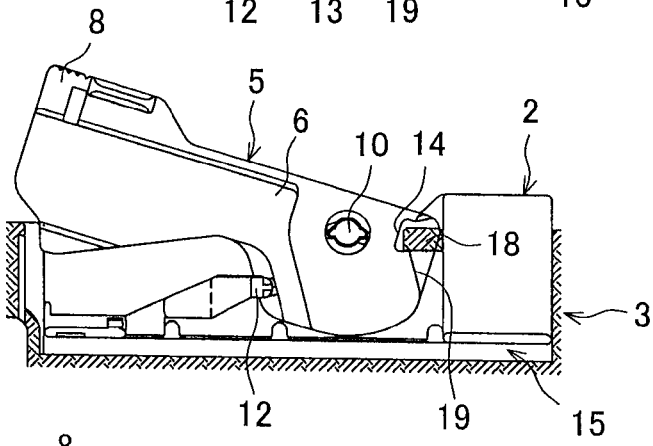
Figure 2D:
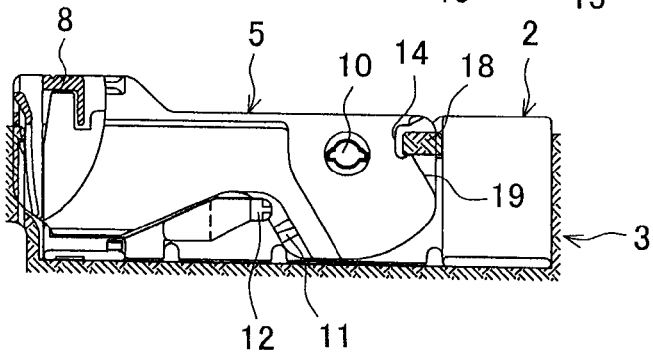

Additionally, when the connector holder 2 is pushed down to the standby position where the receiving portion 18 is inserted into the multiple force recess 14, as shown in FIG. 2B, the restricting recess 19 is away from the rear surface of the receiving portion 18, so that restriction of rotation of the lever 5 is cancelled.

Figure 3:
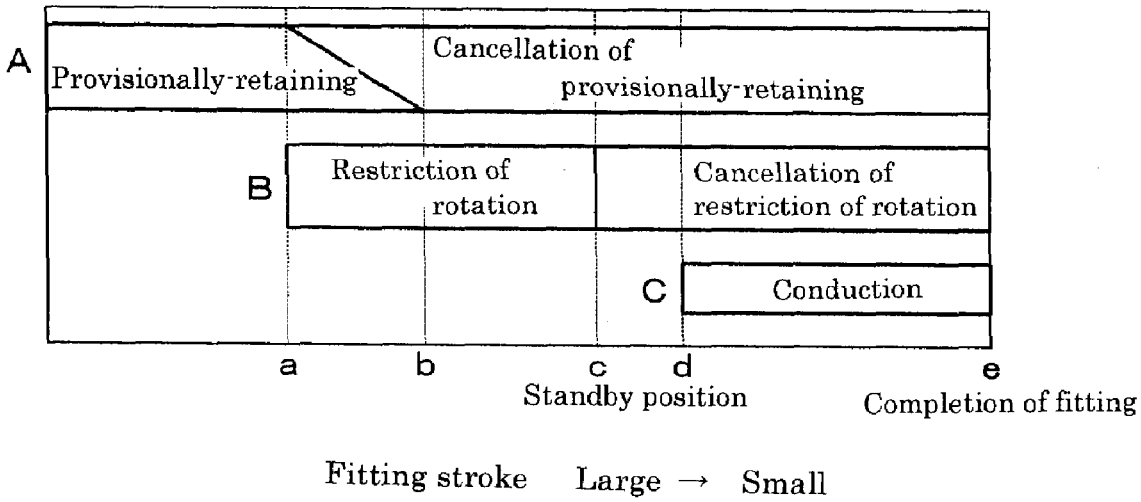
FIG. 3 is a graph showing change of a provisionally-retaining state of a lever, a rotation restriction state of the lever, and a conduction state between terminals in accordance with reduction of fitting stroke of the connector holder.

Fitting operation of the connector 2 in the lever type connector 1 configured as above will be explained with reference to FIGS. 2 and 3. FIG. 3 is a graph showing change of a provisionally-retaining state of the lever 5 by the projection 11 and the retaining claw 12 (graph A), a rotation restriction state of the lever 5 by the receiving portion 18 and the restricting recess 19 (graph B), and a conduction state between terminals (graph C) in accordance with reduction of fitting stroke of the connector holder 2 (increase of an amount of pushdown) toward a fitting completion position shown in the right end.

First, in a state of the lever shown in FIG. 1, the connector holder 2 is inserted into the housing portion 15 of the receptacle connector 3 from the above. Then, the cancellation projection 17 of the receptacle connector 3 engages with the cancellation portion 13 of the provisionally-retaining claw 12 of the connector holder 2, which gradually reducing a provisionally-retaining force from a pushdown position a (that is, an area between a and b in the graph). At this time, in the lever 5 a rear surface of the restricting recess 19 abuts to a rear surface of the receiving portion 18 as shown in FIG. 2A, so that the lever 5 can not be rotated even when the operating portion 8 is pushed.

When the connector holder 2 is pushed down from this position, at a pushdown position b, the cancellation projection 17 allows the provisionally-retaining claw to be deformed, so that the provisionally-retaining claw 12 is away from the projection 11 of the arm plate 6. Consequently, a provisional retaining of the lever 5 by the provisionally-retaining claw 12 is cancelled. When the connector holder 2 is further pushed down, as shown in FIG. 2B, at a pushdown position c, the receiving portion 18 is relatively away from the restricting recess 19 and inserts into the multiple force recess 14 in a state that the provisional retaining of the lever 5 is cancelled. This position is a standby position.

Thus, when the operating portion 8 of the lever 5 is pushed down in this standby position, the rear portion of the multiple force recess 14 abuts to the rear surface of receiving portion 18 and the lever 5 rotates around the abutting portion as a fulcrum. Consequently, as shown FIG. 2C, via the circular projection 10 as an application point the connector holder 2 is pushed down, and the terminals are conducted to each other at a pushdown position d. Then, at a rotating position of the lever 5 where the arm portion 6 lies down (FIG. 2D), the connector holder 2 is completely fit into the receptacle holder 3 (a pushdown position e).

Additionally, when fitting is cancelled, contrary to the above steps, the lever 5 is raised by pulling the operating portion 8, and an upper end of the multiple force recess 14 abuts to an upper end of the receiving portion 18 to rotate the lever 5. Then, the connector holder 2 is ejected upward from the receptacle connector 3 via the circular projection 10.

In the lever type connector 1 as configured above, the lever 5 and the receptacle connector 3 are provided with the receiving portion 18 and the restricting recess 19, respectively, which interfere with each other until the connector holder 2 reaches the standby position. Thus, rotation of the lever 5 before the connector holder reaches the standby position is prevented with a simple structure. Therefore, there is no concern about damage of lever 5 and the like, and the connector holder 2 and the receptacle holder 3 are firmly coupled, whereby a half-fitting is prevented.

In particular, in the lever 5, the restricting recess 19 is continuously provided from the multiple force recess 14, and the restricting recess 19 abuts to the receiving portion 18 of the receptacle connector 3 until the connector holder 2 reaches the standby position, so that rotation of the lever 5 is restricted. Thus, a rational structure is achieved where the receiving portion to be applied a multiple force also serves as a restricting portion, and a metal mold is easily prepared since there is no need for a complex and special structure, so that increasing of cost is prevented. Moreover, since mechanical structure is simplified, there is an advantage that mechanical strength of the lever type connector 1 is secured.

Additionally, the restricting portion of the lever is not limited to a recess defined at an outer surface of an arm portion as described above, and the restricting portion may be formed by cutting the edge of the arm portion.

In addition, in the above embodiment, the restricting recess is continuously provided from the multiple force recess and the receiving portion to be applied a multiple force also serves as a restricting portion. However, not limited to this fulcrum point, the restricting portion (for example, a recess and a projection, and a notch and a projection) interfering with each other at other areas of the arm plate may be provided.

On the other hand, although in the above embodiment a lever type connector having a pair of arm plates is explained, a lever type connector where a lever having one arm plate is rotatably provided at the center of the connecter holder may be adopted to the present invention. Moreover, restriction of rotation of the lever can be respectively performed even when a pair of linearly aligned connector holders is provided, and a pair corresponding housing portions are defined with a receptacle connector.

What is claimed is:

1. A lever type connector comprising:

a connector holder;

a receptacle connector into which the connector holder is configured to be fit at a predetermined fitted position, said receptacle connector including a receiving portion; and a lever provided with the connector holder so as to be rotatable relative to the connector holder about a center of rotation, said lever including a multiple force recess that is offset from the center of rotation and that is configured to engage the receiving portion of the receptacle connector when the lever is rotated while the connector holder is partially inserted into the receptacle connector in a standby position that is located before the predetermined fitted position such that the receiving portion of the receptacle connector acts as a fulcrum so as to assist the connector holder in being pushed down from the standby position to the predetermined fitted position, and a restricting recess configured to interfere with the receiving portion of the receptacle connector so as to restrict rotation of the lever during insertion of the connector holder into the receptacle connector until the connector holder reaches the standby position.

2. A lever type connector according to claim 1, wherein the restricting recess of the lever extends continuously from the multiple force recess of the lever to an edge of the lever, and the connector holder is held by the receiving portion of the receptacle connector so as to restrict rotation of the lever during insertion of the connector holder into the receptacle connector until the connector holder reaches the standby position.

3. A lever type connector according to claim 1, wherein the lever includes a pair of left and right arm plates and an operating portion that extends between an end portion of the left arm and an end portion of the right arm plate.

4. A lever type connector according to claim 3, wherein a hole formed near a front edge portion of each of the left and right arm plates of the lever is engaged with a circular projection respectively provided on a lateral left and right outer surface of the connector holder at the center of rotation, so that the lever rotates around the circular projection.

5. A lever type connector according to claim 3, wherein the multiple force recess is a first wall defined at an edge of each arm plate.

6. A lever type connector according to claim 5, wherein the restricting recess of the lever is a second wall continuously provided from the first wall to an edge of each arm plate.

7. A lever type connector according to claim 3, wherein a projection is provided on a lower edge of a central portion of each arm plate.

8. A lever type connector according to claim 5, wherein the receiving portion of the receptacle connector is provided on an inner surface of the receptacle connector.

9. A lever type connector according to claim 8, wherein the receiving portion is rectangular in shape.

10. A lever type connector according to claim 7, wherein the connector holder includes a retaining claw on a lateral outer surface of the connector holder, and wherein the retaining claw is configured to be held by the projection when the lever is in an inclined position in order to restrict rotation of the lever.

11. A lever type connector according to claim 10, wherein the retaining claw includes a cancellation portion and a retaining portion, and wherein the cancellation portion projects in front of a portion that is outside of the retaining portion with respect to the projection.

12. A lever type connector according to claim 11, wherein the receptacle connector includes a cancellation projection on an inner surface of the receptacle connector, and wherein the cancellation projection is configured to be held by the cancellation portion at the standby position of the connector holder so as to allow the cancellation portion to be deformed to an outer side of the connector holder so that the retaining claw is urged away from the projection.

13. A lever type connector according to claim 12, wherein the cancellation projection has a triangular shape.

14. A lever type connector according to claim 1, wherein the connector holder includes an elongate box shape and is formed of synthetic resin, and wherein a female connector that includes a plurality of terminal insertion portions are arranged is housed in a receiving portion defined within the connector holder.

15. A lever type connector according to claim 14, wherein the receptacle connector includes housing portion for the connector holder that is an elongate box shape and is formed of synthetic resin, and wherein, on a bottom portion of the receptacle connector, a terminal insertion hole is defined to house a terminal corresponding to each terminal of the female connectors held by the connector holder.

* * * * *